United States Patent [19]

Taylor et al.

[11] Patent Number: 4,899,039

[45] Date of Patent: Feb. 6, 1990

[54] PHOTODETECTOR ARRAY FOR SOFT HAT MOUNTING USING A LOOP ANTENNA

[75] Inventors: Leo O. Taylor; Fritz W. Healey, both of Alta Loma, Calif.

[73] Assignee: Loral Electro-Optical Systems Inc., Pasadena, Calif.

[21] Appl. No.: 155,107

[22] Filed: Feb. 11, 1988

[51] Int. Cl.[4] ..... F41G 3/26

[52] U.S. Cl. ..... 250/209; 250/215; 343/866; 434/21

[58] Field of Search ..... 250/208, 209, 214 AG, 250/214 R, 215, 239; 273/310–312; 434/20, 21, 22; 343/718, 866

[56] References Cited

U.S. PATENT DOCUMENTS

| | | | |
|---|---|---|---|
| 2,297,427 | 9/1942 | Neidhardt | 343/866 |
| 2,591,438 | 4/1952 | Kinman et al. | 343/866 |
| 2,904,645 | 9/1959 | Sarles | 343/718 |
| 3,266,042 | 8/1966 | Mahoney et al. | 343/718 |
| 4,063,368 | 12/1977 | McFarland et al. | 434/22 |
| 4,629,427 | 12/1986 | Gallagher | 434/21 |
| 4,688,037 | 8/1987 | Krieg | 250/491.1 |
| 4,695,058 | 9/1987 | Carter, III et al. | 434/22 |

*Primary Examiner*—David C. Nelms
*Assistant Examiner*—Stephone B. Allen
*Attorney, Agent, or Firm*—Lyon & Lyon

[57] ABSTRACT

A photodetector array which mounts to a soft hat, such as a military fatigue hat, and which includes circumferentially spaced and outwardly facing photodetectors on radial arms extending from a central hub. A radio transmitter, including an antenna, is mounted at the hub. The arms extend radially outward to the edge of the hat crown, and then extend down the sides of the hat to the band. Each arm has a proximal end joined to the hub, a radial portion extending to the edge of the hat crown, an axial portion extending towards the hatband and a distal end terminating at a photodetector. A wiring harness is molded within the arms and connects the photodetectors and antenna to the transmitter. A fastener is provided on each arm, at the intersection of the radial and axial portions, to attach the arms to the outer edge of the hat crown. At least two of the arm distal ends are provided with attachments for a chin strap.

5 Claims, 2 Drawing Sheets

PHOTODETECTOR ARRAY FOR SOFT HAT MOUNTING USING A LOOP ANTENNA

BACKGROUND OF THE INVENTION

This invention relates to photodetector arrays for mounting on soft military or police type headgear, such as field caps, utility covers, berets, bush hats, ball caps and fatigue hats. Photodetector arrays may be used with conventional manworn photodetector arrays as described in Technical Report, Volume II, Trainer Engineering Report (Final) For Miles, CDRL Item A002, U.S. Government contract No. N61139-76-0060, May 29, 1980, as Revised Apr. 22, 1981, ("1981 Miles Report"), or as described in our co-pending application entitled Micropower Headgear Photodetector Array, Ser. No. 155,147, filed 2-11-88 now abandoned.

The photodetectors are sensitive to coded laser pulses that are transmitted by various weapons used in non-lethal combat training in which the coded laser beam pulses simulate bullets. The photodetectors generate electrical signals in response to the laser beam pulses which strike a photodetector.

It has been common practice to use body harness photodetector arrays which include a radio receiver tuned to the transmitted signals of a small transmitter attached and connected to a helmet mounted photodetector array. The transmitter link avoids the need to connect the helmet to the body harness with wires. A laser "bullet" hit sensed by a helmet mounted photodetector generates an electrical signal that causes the small radio transmitter on the helmet to send the hit signal to the radio receiver of the body harness to indicate a hit. Prior to the present invention no means has been available to mount photodetector arrays on soft hats or caps.

SUMMARY OF THE INVENTION

A primary object of the present invention is to provide a photodetector array for mounting to a soft hat with its wiring sealed in a resilient structure.

It is another object of the present invention to provide a photodetector array for soft hat mounting wherein photodetector array components are sealed against environmental contamination as well as against tampering by the user.

It is yet another purpose of the present invention to provide a soft hat photodetector array with removable attachment fasteners.

The foregoing objects of the invention are achieved by the present invention which includes a photodetector array mountable to a soft hat, a plurality of photodetectors that are capable of generating an electrical signal from optical stimuli such as coded laser beam pulses, the photodetectors being circumferentially spaced and outwardly facing on a plurality of resilient radial arms radiating from a central hub. A radio transmitter assembly including a source of electrical power is mounted at the hub and has a loop antenna mounted to the arms and coaxially spaced about the transmitter. The arms extend radially outward to the approximate diameter of the hat crown, and then extend axially down the sides of the hat approximately to the hatband. Each arm has a proximal end joined to the hub, a radial portion extending to the edge of the hat crown, and an axial portion extending towards the hatband and a distal end terminating at as photodetector. A wiring harness is molded within the arms and connects the photodetectors to the transmitter assembly and antenna, whereby optical stimuli sensed by any photodetector are conducted to the transmitter and then to the antenna. A fastener is provided on each arm, at the intersection of the radial and axial portions, to attach the photodetector array to the outer edge of the hat crown. At least two of the arm distal ends are provided with means for attachment of a chin strap or cord. The arms and transmitter housing are made of a tough, elastomeric material such as neoprene.

DESCRIPTION OF THE PREFERRED EMBODIMENTS

Figure 1:
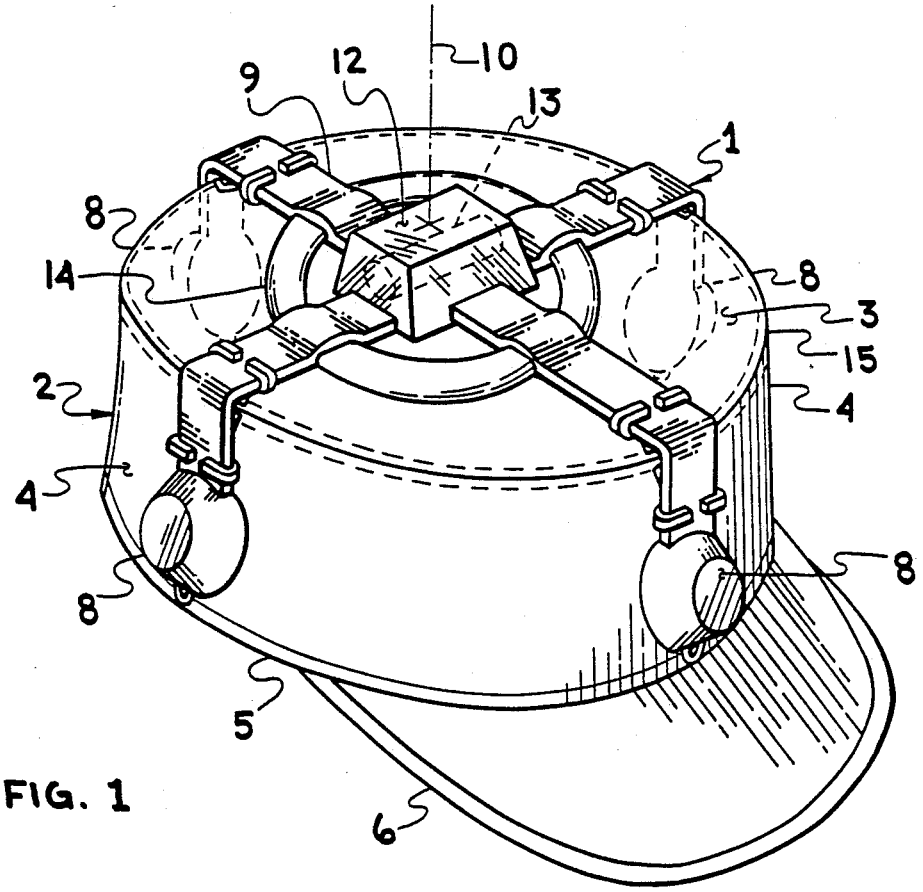
FIG. 1 shows a perspective view of a photodetector array according to the invention, installed on a military fatigue cap.

In FIG. 1 a photodetector array 1 is shown attached to a soft cap 2 having a planar crown 3 and generally vertical sides 4 extending to a band 5 adjacent to a bill 6, and includes a plurality of photodetectors 8 circumferentially spaced and outwardly facing on a plurality of resilient radial arms 9 extending from a central axis 10. A radio transmitter assembly 12, including a battery 13, shown in phantom, is mounted at axis or hub 10 and has a loop antenna 14 mounted to arms 9 and spaced radially outward from transmitter assembly 12 in accordance with the principles described in either the 1981 Miles Report or our co-pending application Ser. No. 155147 filed 2-11-88 now abandoned. The radial portion 20 of arms 9 extend radially outward to the edge 15 of the hat crown, and then axial portions of arms 9 extend down the sides 4 of the hat to near the hatband 5.

Figure 2:
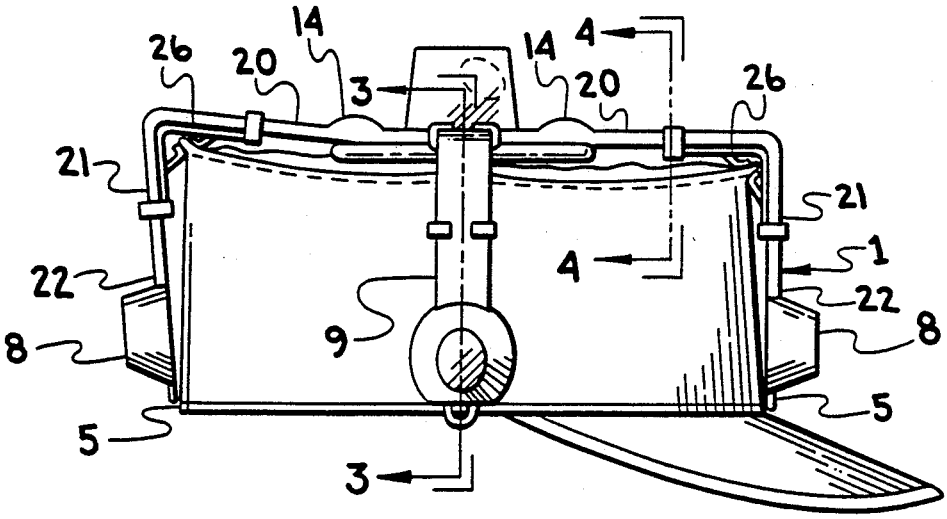
FIG. 2 is a side elevation view of the photodetector array of FIG. 1.

In FIG. 2 the photodetector array 1 is shown attached to hat 2 by the engagement of fasteners 26 provided on each arm 9 at the intersection of the radial portion 20 and an axial portion 21, to attach the photodetector array to the outer edge 15 of hat crown 3. Each arm has a proximal end 16 joined to the hub 10, a radial portion 20 extending to the edge 15 of the crown 3, and an axial portion 21 extending towards the hat band 5 and a distal end 22 terminating at a photodetector 8. At least two of the distal ends 22 are provided with attachments 27 for a chin strap or cord, not shown. Each of the arms 9 is bonded to a respective photodetector 8, as well as bonded to antenna 14 and transmitter 12 to provide a water-tight, tamper proof seal.

Figure 3:
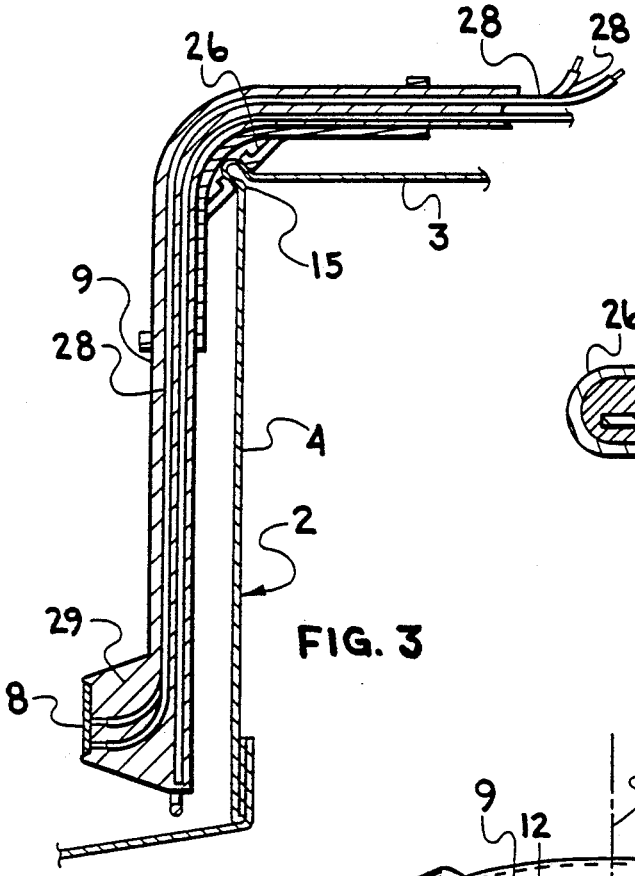
FIG. 3 is a cross-sectional view of a radial arm of the photodetector array of FIG. 2, taken along section line 3—3.

In FIG. 3 a cross-sectional view of a portion of arm 9 in FIG. 2 is shown taken along section line 3—3. The photodetector array 1 is held in place on hat 2 by fastener 26 on arm 9 which engages at the seam 15 at the intersection of crown 3 and side 4. Arm 9 is preferably an elastomeric material, such as rubber, neoprene or other flexible plastic, and is molded or formed around conductors 28 which connect each photodetector 8 and the antenna 14 to the transmitter 12.

Figure 4:
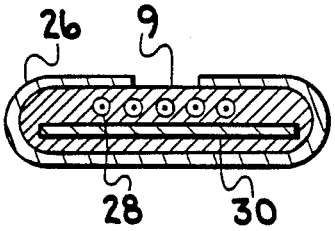
FIG. 4 is a cross-sectional view of an arm of the photodetector array of FIG. 2, taken along section line 4—4.

In FIG. 4 a cross-sectional view of an arm 9 is shown taken along section line 4—4 of FIG. 2. Arm 9 is shown with front cover 46 bonded to rear cover 47 at 48, to define a cavity into which wires 28 are positioned. In a preferred embodiment arm 9 may also encase a flexible, but inelastic elongated strain relief strip 49, which may be made of a metal or made of a fabric such as canvass.

Figure 5:
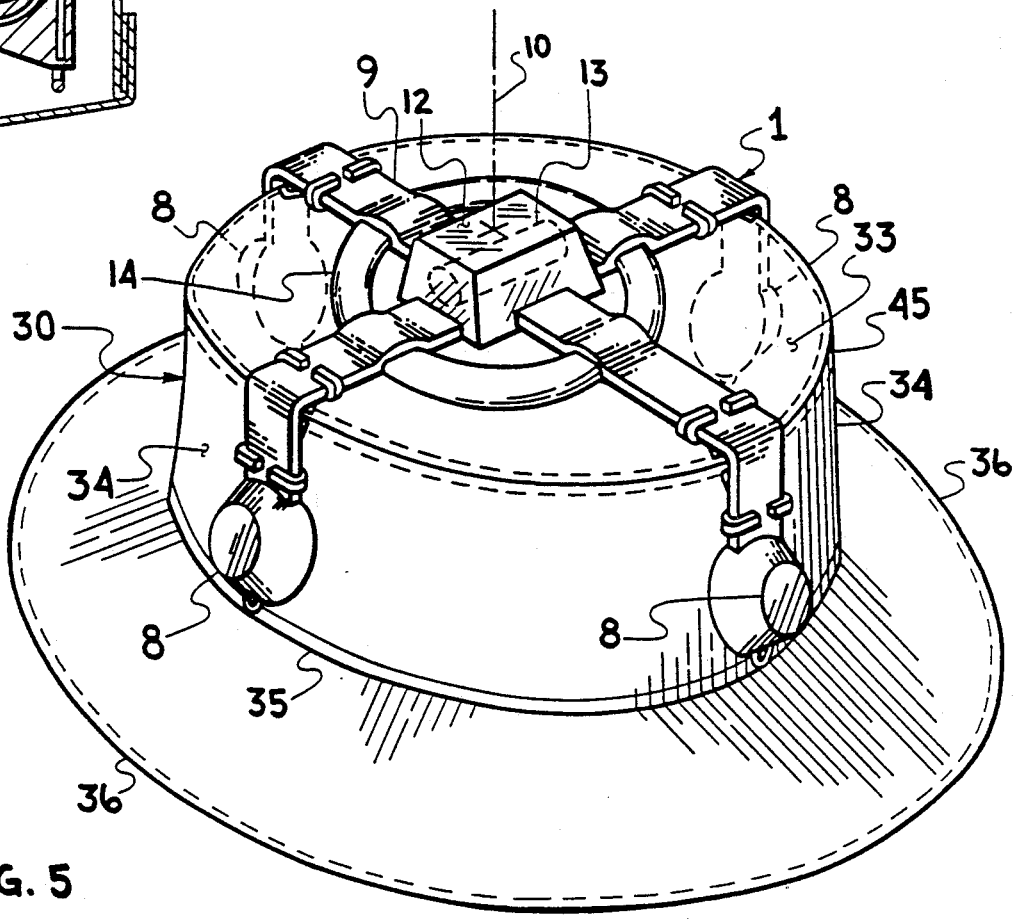
FIG. 5 is a perspective view of the photodetector array of FIG. 1, attached to a military-type hat having a circular brim.

In FIG. 5 a photodetector array 1 having the features of the array of FIG. 1, is shown attached to a soft hat 30. The hat 30 has a planar crown 33 and generally vertical sides 34 depending to a band 35 adjacent to a brim 36, and includes a plurality of photodetectors 8 circumferentially spaced and outwardly facing on a plurality of resilient radial arms 9 radiating from a central axis 10. A radio transmitter assembly 12, including a battery 13 shown in phantom, is mounted at axis 10 and has a loop antenna 14 mounted to arms 9 and coaxially spaced about transmitter assembly 12. The arms 9 extend radially outward to the edge 45 of the hat crown, and then extend axially down the sides 34 of the hat approximately to the band 35. The details of construction and attachment shown in FIGS. 1–4 relating to mounting on a soft cap with a bill are applicable to the array for mounting to a hat with a brim as shown in FIG. 5. The array in accordance with the invention is easily attached without any modification to virtually any type of soft hat or cap.

While we have described preferred embodiments of the herein invention, numerous modifications, alterations and alternate embodiments and materials may be contemplated by those skilled in the art and may be utilized in accomplishing the present invention. It is envisioned that all such alternates are considered to be within the scope of the present invention as defined by the appended claims.

We claim:

1. A soft hat photodetector array including:

a plurality of signal generating photodetectors;

a radio transmitter assembly including a source of power;

a loop antenna electrically coupled to the transmitter;

wiring connecting the photodetectors and antenna to the transmitter whereby signals generated by the photodetectors are received for transmission by the transmitter assembly through the antenna; and means for flexibly mounting said photodetectors, assembly, antenna and wiring to a soft hat.

2. The photodetector array of claim 1 wherein the means for flexibly mounting includes a plurality of flexible arms having radial portions extending from a central hub outward to the edge of the hat crown, and axial portions extending down the sides of the hat to the hatband wherein the arms contain the wiring and are sealed to the photodetectors, assembly and antenna.

3. The photodetector array of claim 2 in which at least two arm distal ends are provided with attachments for a chin strap.

4. The photodetector array of 1, 2 or 3 in which an elongated, flexible strain relief member is molded within each arm along with the wiring.

5. The photodetector array of claim 4 in which the strain relief member is metal.

* * * * *